US006203422B1

(12) United States Patent
Rosal et al.

(10) Patent No.: US 6,203,422 B1
(45) Date of Patent: Mar. 20, 2001

(54) LIGHT ACTIVATED EXHAUST FAN

(76) Inventors: Floro Rosal; Aries Rosal, both of 15910 Cadwell St., La Puenta, CA (US) 91744

( * ) Notice: Subject to any disclaimer, the term of this patent is extended or adjusted under 35 U.S.C. 154(b) by 0 days.

(21) Appl. No.: 09/193,812

(22) Filed: Nov. 17, 1998

(51) Int. Cl.[7] ..... F24F 7/007
(52) U.S. Cl. ..... 454/343; 454/345; 454/354
(58) Field of Search ..... 454/343, 341, 454/349, 354; 126/299 D, 299 R

(56) References Cited

U.S. PATENT DOCUMENTS

| | | | | |
|---|---|---|---|---|
| 4,707,338 | * | 11/1987 | Spector | 422/124 |
| 4,898,086 | * | 2/1990 | Norris | 454/343 |
| 4,953,450 | | 9/1990 | Remondino . | |
| 5,131,888 | | 7/1992 | Adkins | 454/343 |
| 5,640,143 | | 6/1997 | Myron | 340/541 |
| 5,653,632 | * | 8/1997 | Ogawa et al. | 454/343 |

FOREIGN PATENT DOCUMENTS

| | | | | |
|---|---|---|---|---|
| 3836625 | * | 5/1989 | (DE) | 454/343 |
| 2492062 | * | 4/1982 | (FR) | 454/343 |
| 80135 | * | 4/1988 | (JP) | 454/343 |

* cited by examiner

*Primary Examiner*—Harold Joyce
*Assistant Examiner*—Derek S. Boles
(74) *Attorney, Agent, or Firm*—Goldstein & Canino

(57) ABSTRACT

A light activated exhaust fan including an exhaust fan disposed above a ceiling area within a building. The exhaust fan is disposed within a housing. The housing has openings within side walls thereof. The openings in the side walls have ducts extending outwardly therefrom. Outer ends of the ducts extend outwardly of the ceiling area for communication with rooms therebelow. The housing has an opening through an upper end thereof. The opening through the upper end has an exhaust vent extending upwardly therefrom. An outer end of the exhaust vent extends outwardly of the building. The exhaust fan is in communication with a power source. A pair of activation mechanisms are secured within the rooms. The activation mechanisms are in communication with an activation receiver of the exhaust fan.

4 Claims, 2 Drawing Sheets

LIGHT ACTIVATED EXHAUST FAN

BACKGROUND OF THE INVENTION

1. Field of the Invention

The present invention relates to a light activated exhaust fan and more particularly pertains to activating a fan upon the detection of light with a light activated exhaust fan.

2. Description of the Prior Art

The use of ventilation systems is known in the prior art. More specifically, ventilation systems heretofore devised and utilized for the purpose of ventilating a room are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,953,450 to Remondion; U.S. Pat. No. 5,653,632 to Ogawa; U.S. Pat. No. 5,131,888 to Adkins II; and U.S. Pat. No. 5,640,143 to Myron.

While these devices fulfill their respective, particular objective and requirements, the aforementioned patents do not describe a light activated exhaust fan for activating a fan upon the detection of light.

In this respect, the light activated exhaust fan according to the present invention substantially departs from the conventional concepts and designs of the prior art, and in doing so provides an apparatus primarily developed for the purpose of activating a fan upon the detection of light.

Therefore, it can be appreciated that there exists a continuing need for new and improved light activated exhaust fan which can be used for activating a fan upon the detection of light. In this regard, the present invention substantially fulfills this need.

SUMMARY OF THE INVENTION

In the view of the foregoing disadvantages inherent in the known types of ventilation systems now present in the prior art, the present invention provides an improved light activated exhaust fan. As such, the general purpose of the present invention, which will be described subsequently in greater detail, is to provide a new and improved light activated exhaust fan and method which has all the advantages of the prior art and none of the disadvantages.

To attain this, the present invention essentially comprises an exhaust fan disposed above a ceiling area within a building. The exhaust fan is disposed within a housing. The housing has openings within side walls thereof. The openings in the side walls have ducts extending outwardly therefrom. Outer ends of the ducts extend outwardly of the ceiling area for communication with rooms therebelow. The housing has an opening through an upper end thereof. The opening through the upper end has an exhaust vent extending upwardly therefrom. An outer end of the exhaust vent extends outwardly of the building. The exhaust fan is in communication with a power source. A pair of activation mechanisms are secured within the rooms. The activation mechanisms are in communication with an activation receiver of the exhaust fan. The pair of activation mechanisms are comprised of photo cells disposed on an interior surface of the ceiling area adjacent to the outer ends of the ducts.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved light activated exhaust fan which has all the advantages of the prior art ventilation systems and none of the disadvantages.

It is another object of the present invention to provide a new and improved light activated exhaust fan which may be easily and efficiently manufactured and marketed.

It is a further object of the present invention to provide a new and improved light activated exhaust fan which is of durable and reliable construction.

An even further object of the present invention is to provide a new and improved light activated exhaust fan which is susceptible of a low cost of manufacture with regard to both materials and labor, and which accordingly is then susceptible of low prices of sale to the consuming public, thereby making such a light activated exhaust fan economically available to the buying public.

Even still another object of the present invention is to provide a new and improved light activated exhaust fan for activating a fan upon the detection of light.

Lastly, it is an object of the present invention to provide a new and improved light activated exhaust fan including an exhaust fan disposed above a ceiling area within a building. The exhaust fan is disposed within a housing. The housing has openings within side walls thereof. The openings in the side walls have ducts extending outwardly therefrom. Outer ends of the ducts extend outwardly of the ceiling area for communication with rooms therebelow. The housing has an opening through an upper end thereof. The opening through the upper end has an exhaust vent extending upwardly therefrom. An outer end of the exhaust vent extends outwardly of the building. The exhaust fan is in communication with a power source. A pair of activation mechanisms are secured within the rooms. The activation mechanisms are in communication with an activation receiver of the exhaust fan.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
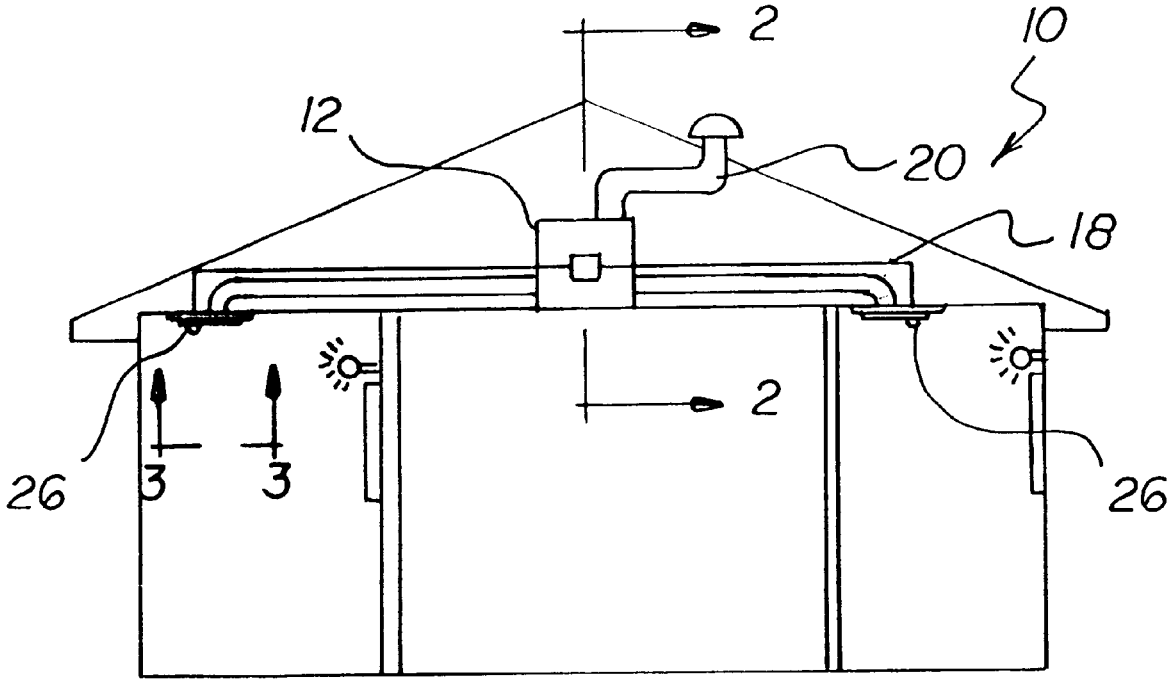
FIG. 1 is a perspective view of the preferred embodiment of the light activated exhaust fan constructed in accordance with the principles of the present invention.
Figure 2:
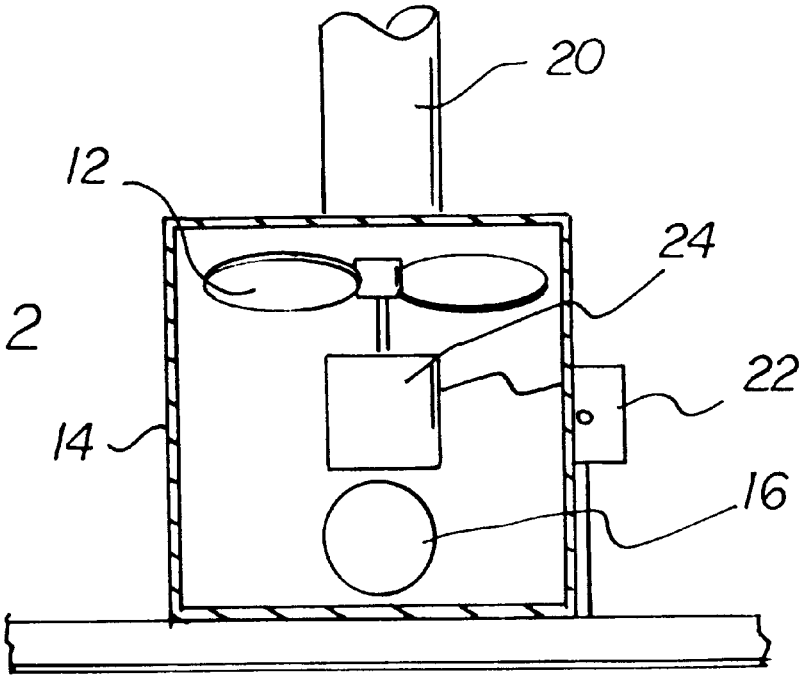
FIG. 2 is a cross-sectional view of the exhaust fan of the present invention.
Figure 3:
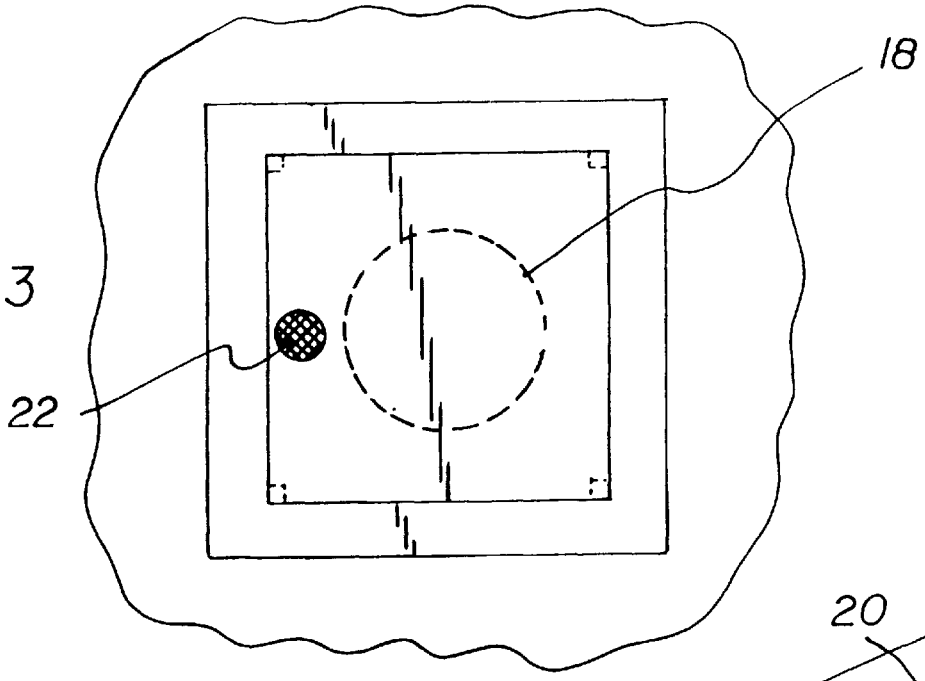
FIG. 3 is a plan view of the photo cell of the present invention as taken along line 3—3 of FIG. 1.

With reference now to the drawings, and in particular, to FIGS. 1 through 4 thereof, the preferred embodiment of the new and improved light activated exhaust fan embodying the principles and concepts of the present invention and generally designated by the reference number 10 will be described.

Specifically, it will be noted in the various Figures that the device relates to a light activated exhaust fan for activating a fan upon the detection of light. In its broadest context, the device consists of an exhaust fan and a pair of activation mechanisms. Such components are individually configured and correlated with respect to each other so as to attain the desired objective.

The exhaust fan 12 is disposed above a ceiling area within a building. The exhaust fan 12 is disposed within a housing 14. The housing 14 has openings 16 within side walls thereof. The openings 16 in the side walls have ducts 18 extending outwardly therefrom. Outer ends of the ducts 18 extend outwardly of the ceiling area for communication with rooms therebelow. The housing 12 has an opening through an upper end thereof. The opening through the upper end has an exhaust vent 20 extending upwardly therefrom. An outer end of the exhaust vent 20 extends outwardly of the building. The exhaust fan 12 is in communication with a power source.

The pair of activation mechanisms are secured within the rooms. The activation mechanisms are in communication with an activation receiver 22 of the exhaust fan 12. The activation receiver 22 is in communication with a motor 24 of the exhaust fan 12. The pair of activation mechanisms are comprised of photo cells 26 disposed on an interior surface of the ceiling area adjacent to the outer ends of the ducts 18. The photo cells, 26 upon activation of a light source within the room, will sent a signal to the activation receiver 22 which will then activate the motor 24 for the exhaust fan 12. When the light source is deactivated, the motor 24 will stop.

Figure 4:
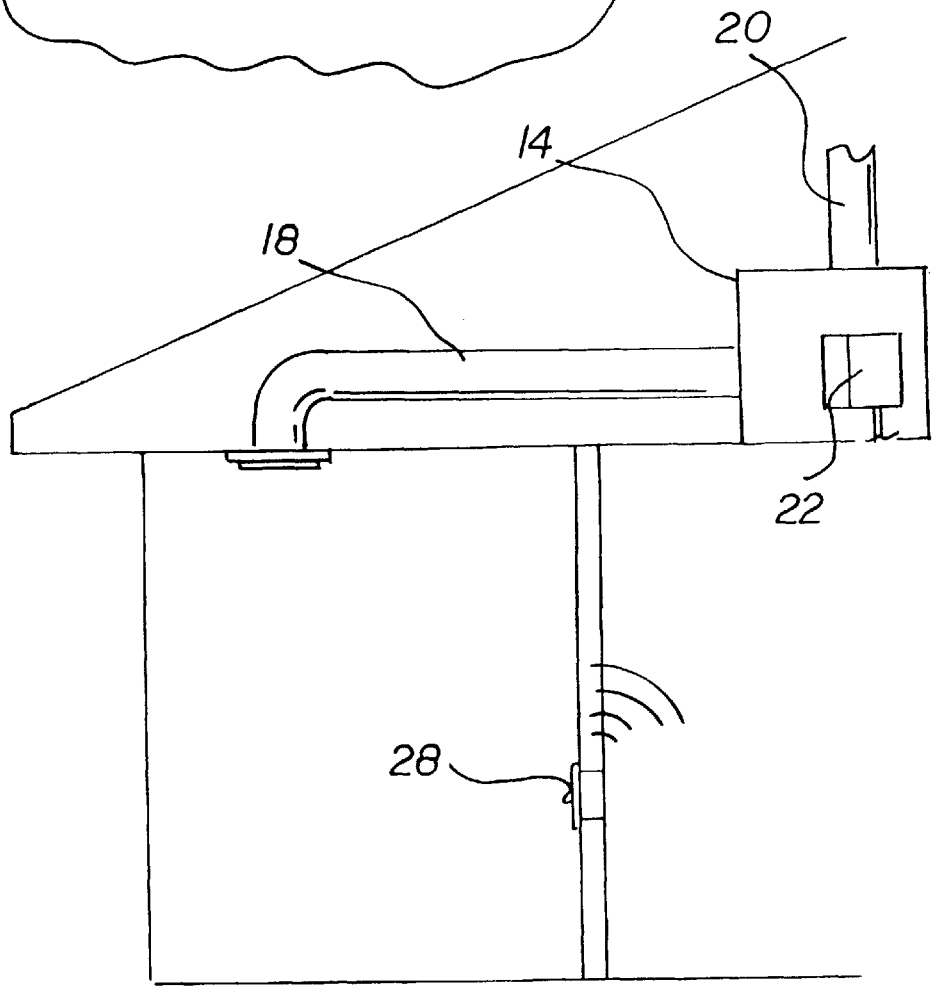
FIG. 4 is a side view of an alternate embodiment of the present invention.

A second embodiment of the present invention is shown in FIG. 4 and includes substantially all of the components of the present invention wherein the photo cells 26 are replaced by remote control units 8. The remote control units 28 allow for the activation of the exhaust fan 12 by simply pressing a switch or the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the united states is as follows:

1. A light activated exhaust fan for activating a fan upon the detection of light comprising, in combination:

an exhaust fan disposed above a ceiling area within a building, the exhaust fan being disposed within a housing, the housing having openings within side walls thereof, the openings in the side walls having ducts extending outwardly therefrom, outer ends of the ducts extending outwardly of the ceiling area for communication with rooms therebelow, the housing having an opening through an upper end thereof, the opening through the upper end having an exhaust vent extending upwardly therefrom, an outer end of the exhaust vent extending outwardly of the building, the exhaust fan being in communication with a power source;

a pair of activation mechanisms secured within the rooms, the activation mechanisms being in communication with an activation receiver of the exhaust fan, the pair of activation mechanisms comprising photo cells disposed on an interior surface of the ceiling area adjacent to the outer ends of the ducts.

2. An exhaust fan for activating a fan comprising, in combination:

an exhaust fan disposed above a ceiling area within a building, the exhaust fan being disposed within a housing, the housing having openings within side walls thereof, the openings in the side walls having ducts extending outwardly therefrom, outer ends of the ducts extending outwardly of the ceiling area for communication with rooms therebelow, the housing having an opening through an upper end thereof, the opening through the upper end having an exhaust vent extending upwardly therefrom, an outer end of the exhaust vent extending outwardly of the building, the exhaust fan being in communication with a power source;

a pair of activation mechanisms secured within the rooms, the activation mechanisms being in communication with an activation receiver of the exhaust fan.

3. The exhaust fan as set forth in claim 2 wherein the pair of activation mechanisms comprises photo cells.

4. The exhaust fan as set forth in claim 2 wherein the pair of activation mechanisms comprises remote control units.

* * * * *